US011217155B1

(12) United States Patent
Liu

(10) Patent No.: US 11,217,155 B1
(45) Date of Patent: Jan. 4, 2022

(54) PIXEL DRIVING CIRCUIT, DRIVING METHOD THEREOF, AND DISPLAY PANEL APPLIED THEREOF

(71) Applicant: SHENZHEN CHINA STAR OPTOELECTRONICS SEMICONDUCTOR DISPLAY TECHNOLOGY CO., LTD., Shenzhen (CN)

(72) Inventor: Shiqi Liu, Shenzhen (CN)

( * ) Notice: Subject to any disclaimer, the term of this patent is extended or adjusted under 35 U.S.C. 154(b) by 257 days.

(21) Appl. No.: 16/627,371

(22) PCT Filed: Dec. 24, 2019

(86) PCT No.: PCT/CN2019/127885
§ 371 (c)(1),
(2) Date: Dec. 30, 2019

(87) PCT Pub. No.: WO2021/109288
PCT Pub. Date: Jun. 10, 2021

(30) Foreign Application Priority Data

Dec. 4, 2019 (CN) ..... 201911226261.4

(51) Int. Cl.
*G09G 3/3225* (2016.01)

(52) U.S. Cl.
CPC ... *G09G 3/3225* (2013.01); *G09G 2300/0452* (2013.01); *G09G 2300/0465* (2013.01); *G09G 2300/0804* (2013.01); *G09G 2300/0842* (2013.01); *G09G 2310/0235* (2013.01)

(58) Field of Classification Search
CPC ..... G09G 2310/0235
See application file for complete search history.

(56) References Cited

U.S. PATENT DOCUMENTS 10,176,742 B2 * 1/2019 Yang ..... G09G 3/2003
2004/0222746 A1 * 11/2004 Winters ..... H01L 27/3244 315/167
2005/0104875 A1 * 5/2005 Kwak ..... G09G 3/3233 345/204
2005/0200573 A1 * 9/2005 Kwak ..... G09G 3/3233 345/76
2006/0022909 A1 * 2/2006 Kwak ..... G09G 3/3233 345/76
2007/0152923 A1 * 7/2007 Baik ..... G09G 3/3233 345/76
2010/0103153 A1 * 4/2010 Satoh ..... G09G 3/3677 345/208
2011/0298775 A1 * 12/2011 Mori ..... G09G 3/3225 345/211

(Continued)

*Primary Examiner* — Sepehr Azari

(57) ABSTRACT

A pixel driving circuit, a driving method thereof, and a display panel applied thereof, which comprise three thin film transistors are provided. A control terminal, a first terminal, and a second terminal of a first thin film transistor are respectively electrically coupled to a first node, a high preset potential, and a second node. A control terminal, a first terminal, and a second terminal of a second thin film transistor are respectively electrically connected to a scan line, the first node, and a data line. A control terminal, a first terminal, and a second terminal of a third thin film transistor are respectively electrically connected to a scan line, a third node, and the second node.

12 Claims, 1 Drawing Sheet

(56) References Cited

U.S. PATENT DOCUMENTS

| | | | | |
|---|---|---|---|---|
| 2016/0012774 | A1* | 1/2016 | Ohara | G09G 3/3233<br>345/694 |
| 2018/0357961 | A1* | 12/2018 | Yang | G09G 3/3266 |
| 2019/0012948 | A1* | 1/2019 | Ohara | G09G 3/3233 |
| 2019/0279565 | A1* | 9/2019 | Yang | G09G 3/3275 |

* cited by examiner

PIXEL DRIVING CIRCUIT, DRIVING METHOD THEREOF, AND DISPLAY PANEL APPLIED THEREOF

FIELD OF INVENTION

The present disclosure relates to the display field, and more particularly, to a pixel driving circuit, a driving method thereof, and a display panel applied thereof.

BACKGROUND OF INVENTION

Liquid crystal displays (LCDs) are flat panel display device which use characteristics of liquid crystal materials to display images. Compared with other display devices, they have the advantages of light weight, low driving voltage, and low power consumption.

With the demand for high-definition displays, integrated circuits and display industry are continuing developing and innovating. Various high-resolution displays account for a majority of products of major terminal brands, and active-matrix organic light-emitting diode (AMOLED) products are also one of these products. However, with the increase of resolution, layout space of pixels must be compressed, such as wiring width compression, capacitor area compression, etc. That is a big challenge for both manufacturing process and design.

SUMMARY OF INVENTION

Current organic light-emitting diode (OLED) driving circuit adopts a structure of three thin film transistors and one capacitor (3T1C), that is, driving a sub-pixel needs three thin film transistors and one capacitor. However, the present disclosure adopts seven thin film transistors and three capacitors to drive three sub-pixels at the same time. According to current scheme, driving three sub-pixels requires nine thin film transistors and three capacitors, so two thin film transistors and two capacitors can be saved, thereby saving space.

Thus, the present disclosure provides a new pixel driving circuit to better adapt to high-resolution designs.

To resolve above technical problems, one purpose of the present disclosure is to provide a pixel driving circuit. The pixel driving circuit comprises a first thin film transistor, wherein a control terminal of the first thin film transistor is electrically coupled to a first node, a first terminal of the first thin film transistor is used for connecting to a high preset potential, and a second terminal of the first thin film transistor is electrically coupled to a second node; a second thin film transistor, wherein a control terminal of the second thin film transistor is electrically coupled to a scan line, a first terminal of the second thin film transistor is electrically coupled to the first node, and a second terminal of the second thin film transistor is electrically coupled to a data line; a third thin film transistor, wherein a control terminal of the third thin film transistor is electrically coupled to the scan line, a first terminal of the third thin film transistor is electrically coupled to a third node, and a second terminal of the third thin film transistor is electrically coupled to the second node; a fourth thin film transistor, wherein a control terminal of the fourth thin film transistor receives a frequency signal, a first terminal of the fourth thin film transistor is used for connecting to a low preset potential, and a second terminal of the fourth thin film transistor is electrically coupled to the third node; a fifth thin film transistor, wherein a control terminal of the fifth thin film transistor is electrically connected to a red pixel data line, a first terminal of the fifth thin film transistor is electrically coupled to a fourth node, and a second terminal of the fifth thin film transistor is electrically coupled to the third node; a sixth thin film transistor, wherein a control terminal of the sixth thin film transistor is electrically connected to a green pixel data line, a first terminal of the sixth thin film transistor is electrically coupled to the fourth node, and a second terminal of the sixth thin film transistor is electrically coupled to the third node; a seventh thin film transistor, wherein a control terminal of the seventh thin film transistor is electrically connected to a blue pixel data line, a first terminal of the seventh thin film transistor is electrically coupled to the fourth node, and a second terminal of the seventh thin film transistor is electrically coupled to the third node; and a storage capacitor, wherein one terminal of the storage capacitor is electrically coupled to the first node, and another terminal of the storage capacitor is electrically coupled to the second node.

The purpose of the present disclosure and the technical problems resolved are achieved by using the following technical solutions.

In one embodiment of the present disclosure, the pixel driving circuit further comprises a red light-emitting diode, one terminal of the red light-emitting diode is electrically coupled to the third node, and another terminal of the red light-emitting diode is electrically coupled to the low preset potential.

In one embodiment of the present disclosure, the pixel driving circuit further comprises a green light-emitting diode, one terminal of the green light-emitting diode is electrically coupled to the third node, and another terminal of the green light-emitting diode is electrically coupled to the low preset potential.

In one embodiment of the present disclosure, the pixel driving circuit further comprises a blue light-emitting diode, one terminal of the blue light-emitting diode is electrically coupled to the third node, and another terminal of the blue light-emitting diode is electrically coupled to the low preset potential.

The purpose of the present disclosure and the technical problems resolved are further achieved by using the following technical solutions.

Another purpose of the present disclosure is to provide a display panel. The display panel comprises a first substrate and a second substrate disposed opposite to the first substrate. The first substrate further comprises a pixel driving circuit. The pixel driving circuit comprises a first thin film transistor, wherein a control terminal of the first thin film transistor is electrically coupled to a first node, a first terminal of the first thin film transistor is used for connecting to a high preset potential, and a second terminal of the first thin film transistor is electrically coupled to a second node; a second thin film transistor, wherein a control terminal of the second thin film transistor is electrically coupled to a scan line, a first terminal of the second thin film transistor is electrically coupled to the first node, and a second terminal of the second thin film transistor is electrically coupled to a data line; a third thin film transistor, wherein a control terminal of the third thin film transistor is electrically coupled to the scan line, a first terminal of the third thin film transistor is electrically coupled to a third node, and a second terminal of the third thin film transistor is electrically coupled to the second node; a fourth thin film transistor, wherein a control terminal of the fourth thin film transistor receives a frequency signal, a first terminal of the fourth thin film transistor is used for connecting to a low preset potential, and a second terminal of the fourth thin film transistor is electrically coupled to the third node; a fifth thin film transistor, wherein a control terminal of the fifth thin film transistor is electrically connected to a red pixel data line, a first terminal of the fifth thin film transistor is electrically coupled to a fourth node, and a second terminal of the fifth thin film transistor is electrically coupled to the third node; a sixth thin film transistor, wherein a control terminal of the sixth thin film transistor is electrically connected to a green pixel data line, a first terminal of the sixth thin film transistor is electrically coupled to the fourth node, and a second terminal of the sixth thin film transistor is electrically coupled to the third node; a seventh thin film transistor, wherein a control terminal of the seventh thin film transistor is electrically connected to a blue pixel data line, a first terminal of the seventh thin film transistor is electrically coupled to the fourth node, and a second terminal of the seventh thin film transistor is electrically coupled to the third node; a storage capacitor, wherein one terminal of the storage capacitor is electrically coupled to the first node, and another terminal of the storage capacitor is electrically coupled to the second node; a red light-emitting diode, one terminal of the red light-emitting diode is electrically coupled to the third node, and another terminal of the red light-emitting diode is electrically coupled to the low preset potential; a green light-emitting diode, one terminal of the green light-emitting diode is electrically coupled to the third node, and another terminal of the green light-emitting diode is electrically coupled to the low preset potential; and a blue light-emitting diode, one terminal of the blue light-emitting diode is electrically coupled to the third node, and another terminal of the blue light-emitting diode is electrically coupled to the low preset potential.

The other purpose of the present disclosure provides a driving method of a pixel driving circuit. The driving method of a pixel driving circuit comprises: providing a first thin film transistor, wherein a control terminal of the first thin film transistor is electrically coupled to a first node, a first terminal of the first thin film transistor is used for connecting to a high preset potential, and a second terminal of the first thin film transistor is electrically coupled to a second node; providing a second thin film transistor, wherein a control terminal of the second thin film transistor is electrically coupled to a scan line, a first terminal of the second thin film transistor is electrically coupled to the first node, and a second terminal of the second thin film transistor is electrically coupled to a data line; providing a third thin film transistor, wherein a control terminal of the third thin film transistor is electrically coupled to the scan line, a first terminal of the third thin film transistor is electrically coupled to a third node, and a second terminal of the third thin film transistor is electrically coupled to the second node; providing a fourth thin film transistor, wherein a control terminal of the fourth thin film transistor receives a frequency signal, a first terminal of the fourth thin film transistor is used for connecting to a low preset potential, and a second terminal of the fourth thin film transistor is electrically coupled to the third node; providing a fifth thin film transistor, wherein a control terminal of the fifth thin film transistor is electrically connected to a red pixel data line, a first terminal of the fifth thin film transistor is electrically coupled to a fourth node, and a second terminal of the fifth thin film transistor is electrically coupled to the third node; providing a sixth thin film transistor, wherein a control terminal of the sixth thin film transistor is electrically connected to a green pixel data line, a first terminal of the sixth thin film transistor is electrically coupled to the fourth node, and a second terminal of the sixth thin film transistor is electrically coupled to the third node; providing a seventh thin film transistor, wherein a control terminal of the seventh thin film transistor is electrically connected to a blue pixel data line, a first terminal of the seventh thin film transistor is electrically coupled to the fourth node, and a second terminal of the seventh thin film transistor is electrically coupled to the third node; and providing a storage capacitor, wherein one terminal of the storage capacitor is electrically coupled to the first node, and another terminal of the storage capacitor is electrically coupled to the second node.

In one embodiment of the present disclosure, a driving method of the pixel driving circuit comprises providing a red light-emitting diode, wherein one terminal of the red light-emitting diode is electrically coupled to the third node, and another terminal of the red light-emitting diode is electrically coupled to the low preset potential.

In one embodiment of the present disclosure, a driving method of the pixel driving circuit comprises providing a green light-emitting diode, wherein one terminal of the green light-emitting diode is electrically coupled to the third node, and another terminal of the green light-emitting diode is electrically coupled to the low preset potential.

In one embodiment of the present disclosure, a driving method of the pixel driving circuit comprises providing a blue light-emitting diode, wherein one terminal of the blue light-emitting diode is electrically coupled to the third node, and another terminal of the blue light-emitting diode is electrically coupled to the low preset potential.

The present disclosure provides a new pixel driving circuit to better adapt to high-resolution designs.

DESCRIPTION OF DRAWINGS

In order to more clearly illustrate the technical solutions of the embodiments of the present invention, the drawings used in the description of the embodiments will be briefly described as below. Obviously, the drawings described as below are just some embodiments of the present invention. For one of ordinary skill in the art, under the premise of no creative labor, other drawings can also be obtained according to these drawings.

DETAILED DESCRIPTION OF PREFERRED EMBODIMENTS

Figure 1:
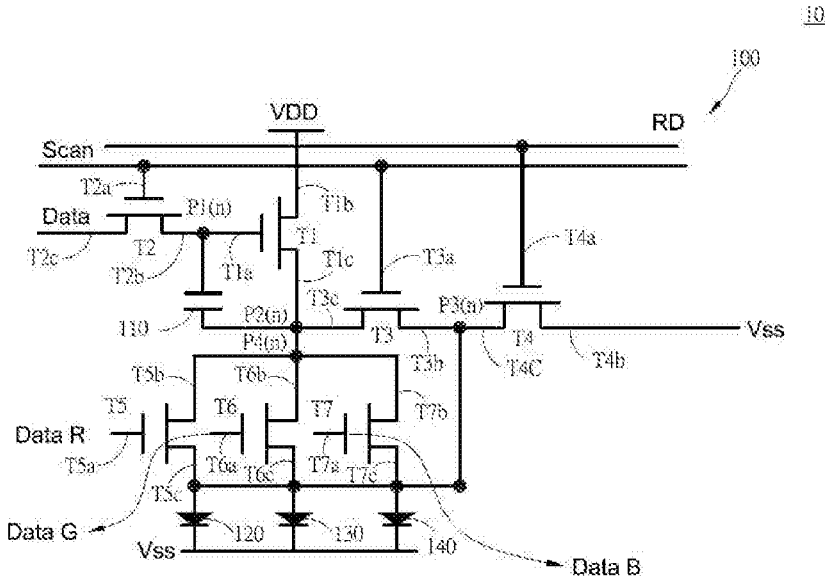
FIG. 1 is a schematic diagram of a pixel driving circuit of an embodiment in the present disclosure.

Refer to drawings, the same component symbols represent the same components. The following description is based on exemplified specific embodiments of the present disclosure, which should not be construed as limiting other specific embodiments not detailed herein.

The following description of the embodiments with reference to the appended drawings is used for illustrating specific embodiments which may be used for carrying out the present disclosure. The directional terms described by the present disclosure, such as "upper", "lower", "front", "back", "left", "right", "inner", "outer", "side", etc., are only directions by referring to the accompanying drawings. Thus, the adopted directional terms are used to describe and understand the present disclosure, but the present disclosure is not limited thereto.

In the drawings, thicknesses of layers, films, panels, regions, etc. are exaggerated for clarity. In the drawings, thicknesses of some layers and regions are exaggerated for understanding and ease of description. It should be noted that, when a component such as a layer, a film, a region, or a substrate is referred to as being "on" another component, the component may be directly on the other components, or be between other components.

The drawings and the description are to be regarded as illustrative, but the present disclosure is not limited thereto. In the drawings, elements with similar structures are indicated by the same numbers. In addition, in order to understand and easily descript, sizes and thicknesses of each components shown in the drawings are regarded as illustrative, but the present disclosure is not limited thereto.

In addition, in the specification, unless explicitly described to the contrary, the term "comprising" will be understood to mean including the recited component, but not excluding any other components. Furthermore, in the specification, "on" means above or below the target component, and does not mean that it must be on top based on a direction of gravity.

In order to further descript technical means and effects adopted by the present disclosure to achieve intended purposes of invention. The following is combined with the drawings and the specific embodiments to detailed descript that a pixel driving circuit, a driving method thereof, and a display panel used in the present disclosure, especially the specific embodiments, structures, features, and effects thereof.

FIG. 1 is a schematic diagram of a pixel driving circuit of an embodiment in the present disclosure. Referring to FIG. 1, in one embodiment of the present disclosure, a pixel driving circuit 100 comprises a first thin film transistor T1, wherein a control terminal T1*a* of the first thin film transistor T1 is electrically coupled to a first node P1(*n*), a first terminal T1*b* of the first thin film transistor T1 is used for connecting to a high preset potential VDD, and a second terminal T1*c* of the first thin film transistor T1 is electrically coupled to a second node P2(*n*); a second thin film transistor T2, wherein a control terminal T2*a* of the second thin film transistor T2 is electrically coupled to a scan line Scan, a first terminal T2*b* of the second thin film transistor T2 is electrically coupled to the first node P1(*n*), and a second terminal T2*c* of the second thin film transistor T2 is electrically coupled to a data line Data; a third thin film transistor T3, wherein a control terminal T3*a* of the third thin film transistor T3 is electrically coupled to the scan line Scan, a first terminal T3*b* of the third thin film transistor T3 is electrically coupled to a third node P3(*n*), and a second terminal T3*c* of the third thin film transistor T3 is electrically coupled to the second node P2(*n*); a fourth thin film transistor T4, wherein a control terminal T4*a* of the fourth thin film transistor T4 receives a frequency signal RD, a first terminal T4*b* of the fourth thin film transistor T4 is used for connecting to a low preset potential VSS, and a second terminal T4*c* of the fourth thin film transistor T4 is electrically coupled to the third node P3(*n*); a fifth thin film transistor T5, wherein a control terminal T5*a* of the fifth thin film transistor T5 is electrically connected to a red pixel data line Data R, a first terminal T5*b* of the fifth thin film transistor T5 is electrically coupled to a fourth node P4(*n*), and a second terminal T5*c* of the fifth thin film transistor T5 is electrically coupled to the third node P3(*n*); a sixth thin film transistor T6, wherein a control terminal T6*a* of the sixth thin film transistor T6 is electrically connected to a green pixel data line Data G, a first terminal T6*b* of the sixth thin film transistor T6 is electrically coupled to the fourth node P4(*n*), and a second terminal T6*c* of the sixth thin film transistor T6 is electrically coupled to the third node P3(*n*); a seventh thin film transistor T7, wherein a control terminal T7*a* of the seventh thin film transistor T7 is electrically connected to a blue pixel data line Data B, a first terminal T7*b* of the seventh thin film transistor T7 is electrically coupled to the fourth node P4(*n*), and a second terminal T7*c* of the seventh thin film transistor T7 is electrically coupled to the third node P3(*n*); and a storage capacitor 110, wherein one terminal of the storage capacitor 110 is electrically coupled to the first node P1(*n*), and another terminal of the storage capacitor 110 is electrically coupled to the second node P2(*n*).

In one embodiment of the present disclosure, the pixel driving circuit 100 comprises a red light-emitting diode 120, one terminal of the red light-emitting diode 120 is electrically coupled to the third node P3(*n*), and another terminal of the red light-emitting diode 120 is electrically coupled to the low preset potential VSS.

In one embodiment of the present disclosure, the pixel driving circuit 100 comprises a green light-emitting diode 130, one terminal of the green light-emitting diode 130 is electrically coupled to the third node P3(*n*), and another terminal of the green light-emitting diode 130 is electrically coupled to the low preset potential VSS.

In one embodiment of the present disclosure, the pixel driving circuit 100 comprises a blue light-emitting diode 140, one terminal of the blue light-emitting diode 140 is electrically coupled to the third node P3(*n*), and another terminal of the blue light-emitting diode 140 is electrically coupled to the low preset potential VSS.

Referring to FIG. 1, in one embodiment of the present disclosure, a display panel 10 comprises a first substrate (not shown) and a second substrate (not shown) disposed opposite to the first substrate (not shown). The display panel 10 further comprises a pixel driving circuit 100. The pixel driving circuit 100 comprises a first thin film transistor T1, wherein a control terminal T1*a* of the first thin film transistor T1 is electrically coupled to a first node P1(*n*), a first terminal T1*b* of the first thin film transistor T1 is used for connecting to a high preset potential VDD, and a second terminal T1*c* of the first thin film transistor T1 is electrically coupled to a second node P2(*n*); a second thin film transistor T2, wherein a control terminal T2*a* of the second thin film transistor T2 is electrically coupled to a scan line Scan, a first terminal T2*b* of the second thin film transistor T2 is electrically coupled to the first node P1(*n*), and a second terminal T2*c* of the second thin film transistor T2 is electrically coupled to a data line Data; a third thin film transistor T3, wherein a control terminal T3*a* of the third thin film transistor T3 is electrically coupled to the scan line Scan, a first terminal T3*b* of the third thin film transistor T3 is electrically coupled to a third node P3(*n*), and a second terminal T3*c* of the third thin film transistor T3 is electrically coupled to the second node P2(*n*); a fourth thin film transistor T4, wherein a control terminal T4*a* of the fourth thin film transistor T4 receives a frequency signal RD, a first terminal T4*b* of the fourth thin film transistor T4 is used for connecting to a low preset potential VSS, and a second terminal T4*c* of the fourth thin film transistor T4 is electrically coupled to the third node P3(*n*); a fifth thin film transistor T5, wherein a control terminal T5*a* of the fifth thin film transistor T5 is electrically connected to a red pixel data line Data R, a first terminal T5*b* of the fifth thin film transistor T5 is electrically coupled to a fourth node P4(*n*), and a second terminal T5*c* of the fifth thin film transistor T5 is electrically coupled to the third node P3(*n*); a sixth thin film transistor T6, wherein a control terminal T6*a* of the sixth thin film transistor T6 is electrically connected to a green pixel data line Data G, a first terminal T6*b* of the sixth thin film transistor T6 is electrically coupled to the fourth node P4(*n*), and a second terminal T6*c* of the sixth thin film transistor T6 is electrically coupled to the third node P3(*n*); a seventh thin film transistor T7, wherein a control terminal T7*a* of the seventh thin film transistor T7 is electrically connected to a blue pixel data line Data B, a first terminal T7*b* of the seventh thin film transistor T7 is electrically coupled to the fourth node P4(*n*), and a second terminal T7*c* of the seventh thin film transistor T7 is electrically coupled to the third node P3(*n*); and a storage capacitor 110, wherein one terminal of the storage capacitor 110 is electrically coupled to the first node P1(*n*), and another terminal of the storage capacitor 110 is electrically coupled to the second node P2(*n*).

In one embodiment of the present disclosure, a driving method of a pixel driving circuit 100 comprises: providing a first thin film transistor T1, wherein a control terminal T1*a* of the first thin film transistor T1 is electrically coupled to a first node P1(*n*), a first terminal T1*b* of the first thin film transistor T1 is used for connecting to a high preset potential VDD, and a second terminal T1*c* of the first thin film transistor T1 is electrically coupled to a second node P2(*n*); providing a second thin film transistor T2, wherein a control terminal T2*a* of the second thin film transistor T2 is electrically coupled to a scan line Scan, a first terminal T2*b* of the second thin film transistor T2 is electrically coupled to the first node P1(*n*), and a second terminal T2*c* of the second thin film transistor T2 is electrically coupled to a data line Data; providing a third thin film transistor T3, wherein a control terminal T3*a* of the third thin film transistor T3 is electrically coupled to the scan line Scan, a first terminal T3*b* of the third thin film transistor T3 is electrically coupled to a third node P3(*n*), and a second terminal T3*c* of the third thin film transistor T3 is electrically coupled to the second node P2(*n*); providing a fourth thin film transistor T4, wherein a control terminal T4*a* of the fourth thin film transistor T4 receives a frequency signal RD, a first terminal T4*b* of the fourth thin film transistor T4 is used for connecting to a low preset potential VSS, and a second terminal T4*c* of the fourth thin film transistor T4 is electrically coupled to the third node P3(*n*); providing a fifth thin film transistor T5, wherein a control terminal T5*a* of the fifth thin film transistor T5 is electrically connected to a red pixel data line Data R, a first terminal T5*b* of the fifth thin film transistor T5 is electrically coupled to a fourth node P4(*n*), and a second terminal T5*c* of the fifth thin film transistor T5 is electrically coupled to the third node P3(*n*); providing a sixth thin film transistor T6, wherein a control terminal T6*a* of the sixth thin film transistor T6 is electrically connected to a green pixel data line Data G, a first terminal T6*b* of the sixth thin film transistor T6 is electrically coupled to the fourth node P4(*n*), and a second terminal T6*c* of the sixth thin film transistor T6 is electrically coupled to the third node P3(*n*); providing a seventh thin film transistor T7, wherein a control terminal T7*a* of the seventh thin film transistor T7 is electrically connected to a blue pixel data line Data B, a first terminal T7*b* of the seventh thin film transistor T7 is electrically coupled to the fourth node P4(*n*), and a second terminal T7*c* of the seventh thin film transistor T7 is electrically coupled to the third node P3(*n*); and providing a storage capacitor 110, wherein one terminal of the storage capacitor 110 is electrically coupled to the first node P1(*n*), and another terminal of the storage capacitor 110 is electrically coupled to the second node P2(*n*).

In one embodiment of the present disclosure, the driving method of a pixel driving circuit 100 further comprises providing a red light-emitting diode 120, one terminal of the red light-emitting diode 120 is electrically coupled to the third node P3(*n*), and another terminal of the red light-emitting diode 120 is electrically coupled to the low preset potential VSS.

In one embodiment of the present disclosure, the driving method of a pixel driving circuit 100 further comprises providing a green light-emitting diode 130, one terminal of the green light-emitting diode 130 is electrically coupled to the third node P3(*n*), and another terminal of the green light-emitting diode 130 is electrically coupled to the low preset potential VSS.

In one embodiment of the present disclosure, the driving method of a pixel driving circuit 100 further comprises providing a blue light-emitting diode 140, one terminal of the blue light-emitting diode 140 is electrically coupled to the third node P3(*n*), and another terminal of the blue light-emitting diode 140 is electrically coupled to the low preset potential VSS.

In one embodiment of the present disclosure, most layout space is saved by adopting one nT-1C pixel circuit to drive n−4 pixels, which is advantageous for high-resolution product development. As shown in FIG. 1, compared with traditional circuit, the present disclosure adopts 7T-1C pixel circuit to drive 3 pixels to emit light, which saves 2/9 of TFT space and 2/3 of capacitor space.

Figure 2:
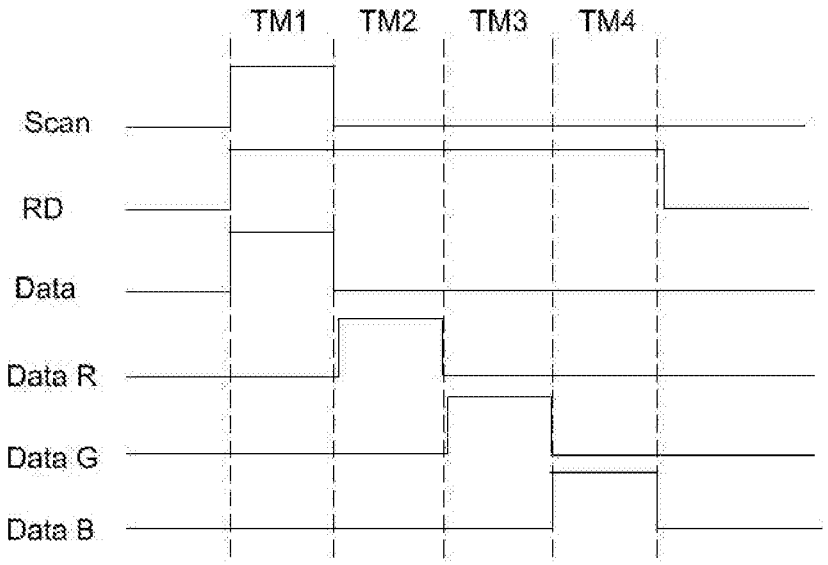
FIG. 2 is a schematic diagram of a waveform output of the pixel driving circuit of the embodiment in the present disclosure.

FIG. 2 is a schematic diagram of a waveform output of a pixel driving circuit of an embodiment in the present disclosure. Referring to FIG. 1 and FIG. 2, in one embodiment of the present disclosure, a specific Vth obtained method of the circuit is as follows.

In a first period (TM1), a scan line (Scan) is a high potential, a frequency signal (RD) is a high potential, a data line (Data) is a high potential, a red pixel data line (Data R) is a low potential, a green pixel data line (Data G) is a low potential, and a blue pixel data line (Data B) is a low potential. Meanwhile, a first thin film transistor T1, a second thin film transistor T2, a third thin film transistor T3, and a fourth thin film transistor T4 are turned on and a storage capacitor (Cst) is charged. At this time, the main supply current of the first thin film transistor T1 may be adjusted.

In a second period (TM2), the scan line (Scan) is a low potential, the frequency signal (RD) is a high potential, the data line (Data) is a low potential, the red pixel data line (Data R) is a high potential, the green pixel data line (Data G) is a low potential, and the blue pixel data line (Data B) is a low potential. Meanwhile, the fourth thin film transistor T4 and a fifth thin film transistor T5 are turned on to control a red light-emitting diode (R) to emit light and obtain a third node P3 (*n*) voltage of the fifth thin film transistor T5. At this time, a Vth of the fifth thin film transistor T5 may be obtained.

In a third period (TM3), the scan line (Scan) is a low potential, the frequency signal (RD) is a high potential, the data line (Data) is a low potential, the red pixel data line (Data R) is a low potential, the green pixel data line (Data G) is a high potential, and the blue pixel data line (Data B) is a low potential. Meanwhile, the fourth thin film transistor T4 and a sixth thin film transistor T6 are turned on to control a green light-emitting diode (G) to emit light and obtain a third node P3 (*n*) voltage of the sixth thin film transistor T6. At this time, the Vth of the fifth thin film transistor T5 may be obtained.

In a fourth period (TM4), the scan line (Scan) is a low potential, the frequency signal (RD) is a high potential, the data line (Data) is a low potential, the red pixel data line (Data R) is a low potential, the green pixel data line (Data G) is a low potential, and the blue pixel data line (Data B) is a high potential. Meanwhile, the fourth thin film transistor T4 and a seventh thin film transistor T7 are turned on to control a blue light-emitting diode (B) to emit light and obtain a third node P3 (*n*) voltage of the seventh thin film transistor T7. At this time, the Vth of the fifth thin film transistor T5 may be obtained.

An obtained Vth compensates for an in-plane uneven distribution.

Referring to FIG. 1 and FIG. 2, in one embodiment of the present disclosure, a specific lighting method of a pixel circuit 100 is as follows: a scan line (Scan) is a high potential, a frequency signal (RD) is a high potential, and a data line (Data) is a high potential. A red pixel data line (Data R), a green pixel data line (Data G), and a blue pixel data line (Data B) add an obtained Vth into corresponding pixels, and then select different voltages to light up a red light-emitting diode (R), a green light-emitting diode (G), or a blue light-emitting diode (B) according to brightness of screens.

The present disclosure provides a new pixel driving circuit to better adapt to high-resolution designs.

As described above, for a person of ordinary skill in the art, various other corresponding changes and modifications may be made according to technical solutions and technical concepts of the present disclosure, and all these changes and modifications should belong to a protection scope of the appended claims of the present disclosure.

What is claimed is:

1. A pixel driving circuit, comprising:

a first thin film transistor, wherein a control terminal of the first thin film transistor is electrically coupled to a first node, a first terminal of the first thin film transistor is used for connecting to a high preset potential, and a second terminal of the first thin film transistor is electrically coupled to a second node;

a second thin film transistor, wherein a control terminal of the second thin film transistor is electrically coupled to a scan line, a first terminal of the second thin film transistor is electrically coupled to the first node, and a second terminal of the second thin film transistor is electrically coupled to a data line;

a third thin film transistor, wherein a control terminal of the third thin film transistor is electrically coupled to the scan line, a first terminal of the third thin film transistor is electrically coupled to a third node, and a second terminal of the third thin film transistor is electrically coupled to the second node;

a fourth thin film transistor, wherein a control terminal of the fourth thin film transistor receives a frequency signal, a first terminal of the fourth thin film transistor is used for connecting to a low preset potential, and a second terminal of the fourth thin film transistor is electrically coupled to the third node;

a fifth thin film transistor, wherein a control terminal of the fifth thin film transistor is electrically connected to a red pixel data line, a first terminal of the fifth thin film transistor is electrically coupled to a fourth node, and a second terminal of the fifth thin film transistor is electrically coupled to the third node;

a sixth thin film transistor, wherein a control terminal of the sixth thin film transistor is electrically connected to a green pixel data line, a first terminal of the sixth thin film transistor is electrically coupled to the fourth node, and a second terminal of the sixth thin film transistor is electrically coupled to the third node;

a seventh thin film transistor, wherein a control terminal of the seventh thin film transistor is electrically connected to a blue pixel data line, a first terminal of the seventh thin film transistor is electrically coupled to the fourth node, and a second terminal of the seventh thin film transistor is electrically coupled to the third node; and a storage capacitor, wherein one terminal of the storage capacitor is electrically coupled to the first node, and another terminal of the storage capacitor is electrically coupled to the second node.

2. The pixel driving circuit as claimed in claim 1, comprising a red light-emitting diode, one terminal of the red light-emitting diode is electrically coupled to the third node, and another terminal of the red light-emitting diode is electrically coupled to the low preset potential.

3. The pixel driving circuit as claimed in claim 1, comprising a green light-emitting diode, one terminal of the green light-emitting diode is electrically coupled to the third node, and another terminal of the green light-emitting diode is electrically coupled to the low preset potential.

4. The pixel driving circuit as claimed in claim 1, comprising a blue light-emitting diode, one terminal of the blue light-emitting diode is electrically coupled to the third node, and another terminal of the blue light-emitting diode is electrically coupled to the low preset potential.

5. A display panel, comprising a first substrate and a second substrate disposed opposite to the first substrate, wherein the first substrate comprises the pixel driving circuit as claimed in claim 1.

6. The display panel as claimed in claim 5, wherein the display panel comprises a red light-emitting diode, one terminal of the red light-emitting diode is electrically coupled to the third node, and another terminal of the red light-emitting diode is electrically coupled to the low preset potential.

7. The display panel as claimed in claim 5, comprising a green light-emitting diode, one terminal of the green light-emitting diode is electrically coupled to the third node, and another terminal of the green light-emitting diode is electrically coupled to the low preset potential.

8. The display panel as claimed in claim 5, comprising a blue light-emitting diode, one terminal of the blue light-emitting diode is electrically coupled to the third node, and another terminal of the blue light-emitting diode is electrically coupled to the low preset potential.

9. A driving method of a pixel driving circuit, comprising:

providing a first thin film transistor, wherein a control terminal of the first thin film transistor is electrically coupled to a first node, a first terminal of the first thin film transistor is used for connecting to a high preset potential, and a second terminal of the first thin film transistor is electrically coupled to a second node;

providing a second thin film transistor, wherein a control terminal of the second thin film transistor is electrically coupled to a scan line, a first terminal of the second thin film transistor is electrically coupled to the first node, and a second terminal of the second thin film transistor is electrically coupled to a data line;

providing a third thin film transistor, wherein a control terminal of the third thin film transistor is electrically coupled to the scan line, a first terminal of the third thin film transistor is electrically coupled to a third node, and a second terminal of the third thin film transistor is electrically coupled to the second node;

providing a fourth thin film transistor, wherein a control terminal of the fourth thin film transistor receives a frequency signal, a first terminal of the fourth thin film transistor is used for connecting to a low preset potential, and a second terminal of the fourth thin film transistor is electrically coupled to the third node;

providing a fifth thin film transistor, wherein a control terminal of the fifth thin film transistor is electrically connected to a red pixel data line, a first terminal of the fifth thin film transistor is electrically coupled to a fourth node, and a second terminal of the fifth thin film transistor is electrically coupled to the third node;

providing a sixth thin film transistor, wherein a control terminal of the sixth thin film transistor is electrically connected to a green pixel data line, a first terminal of the sixth thin film transistor is electrically coupled to the fourth node, and a second terminal of the sixth thin film transistor is electrically coupled to the third node;

providing a seventh thin film transistor, wherein a control terminal of the seventh thin film transistor is electrically connected to a blue pixel data line, a first terminal of the seventh thin film transistor is electrically coupled to the fourth node, and a second terminal of the seventh thin film transistor is electrically coupled to the third node; and providing a storage capacitor, wherein one terminal of the storage capacitor is electrically coupled to the first node, and another terminal of the storage capacitor is electrically coupled to the second node.

10. The driving method of the pixel driving circuit as claimed in claim 9, comprising providing a red light-emitting diode, wherein one terminal of the red light-emitting diode is electrically coupled to the third node, and another terminal of the red light-emitting diode is electrically coupled to the low preset potential.

11. The driving method of the pixel driving circuit as claimed in claim 9, comprising providing a green light-emitting diode, wherein one terminal of the green light-emitting diode is electrically coupled to the third node, and another terminal of the green light-emitting diode is electrically coupled to the low preset potential.

12. The driving method of the pixel driving circuit as claimed in claim 9, comprising providing a blue light-emitting diode, wherein one terminal of the blue light-emitting diode is electrically coupled to the third node, and another terminal of the blue light-emitting diode is electrically coupled to the low preset potential.

* * * * *